US008539884B2

(12) United States Patent
Deye

(10) Patent No.: US 8,539,884 B2
(45) **Date of Patent: *Sep. 24, 2013**

(54) REMOTELY CONTROLLED IGNITION SYSTEM FOR PYROTECHNICS

(76) Inventor: James G. Deye, Cincinnati, OH (US)

( * ) Notice: Subject to any disclaimer, the term of this patent is extended or adjusted under 35 U.S.C. 154(b) by 240 days.

This patent is subject to a terminal disclaimer.

(21) Appl. No.: 12/813,170

(22) Filed: Jun. 10, 2010

(65) Prior Publication Data

US 2010/0242770 A1 Sep. 30, 2010

Related U.S. Application Data

(63) Continuation of application No. 11/500,762, filed on Aug. 7, 2006, now Pat. No. 7,757,607.

(60) Provisional application No. 60/708,935, filed on Aug. 17, 2005.

(51) Int. Cl.
*F42B 4/14* (2006.01)
*F42B 3/18* (2006.01)
*F42C 17/04* (2006.01)

(52) U.S. Cl.
USPC ..... 102/357; 102/335; 102/360; 102/206; 102/215

(58) Field of Classification Search
USPC ..... 102/200, 206, 215, 335, 336, 352, 102/360, 361, 357, 342; 434/24; 89/6, 6.5
See application file for complete search history.

(56) References Cited

U.S. PATENT DOCUMENTS 2,459,854 A * 1/1949 Swift, Jr. ..... 89/1.1
2,640,417 A * 6/1953 Bjork et al. ..... 60/256
3,038,384 A * 6/1962 Gaugler ..... 89/1.814
3,809,964 A * 5/1974 Ceyrat ..... 102/202.14
4,145,968 A * 3/1979 Klein ..... 102/202.2
4,158,447 A * 6/1979 Humphries et al. ..... 244/3.27
4,350,096 A * 9/1982 Cannavo et al. ..... 102/209
4,445,434 A * 5/1984 Brede et al. ..... 102/206
4,653,211 A * 3/1987 Brede et al. ..... 42/84
6,422,145 B1 7/2002 Gavrilovic et al.
6,439,097 B1 * 8/2002 Loving ..... 89/1.814
6,945,174 B2 9/2005 Aebi et al.
7,011,220 B2 3/2006 Deye
7,194,959 B2 * 3/2007 Bossarte et al. ..... 102/342
7,314,005 B2 1/2008 Deye
7,327,550 B2 2/2008 Meyer et al.
7,493,859 B2 2/2009 Russell
7,568,429 B2 8/2009 Hummel et al.
7,597,047 B2 10/2009 Doyle et al.
7,617,777 B2 * 11/2009 Bossarte et al. ..... 102/342

* cited by examiner

*Primary Examiner* — James Bergin
(74) *Attorney, Agent, or Firm* — Sand & Sebolt

(57) ABSTRACT

A remote pyrotechnic ignition system includes a power supply for producing an electrical current in a transmitting induction coil to induce an electrical current in a receiving induction coil for igniting a pyrotechnic device. Thus, a wireless ignition communication section allows pyrotechnic mortars to be reused and substantially reduces set-up time by eliminating the wiring of fireworks normally required for a pyrotechnic production. Optionally, a capacitor is charged by the power source via a charging circuit and discharged via a firing circuit to produce the electric current in the transmitting coil in a pulse. The capacitor provides a two-stage firing safety feature. An electronic control device such as a circuit board may be mounted on the pyrotechnic device for controlling ignition of the pyrotechnic device and is especially useful in controlling ignition sequencing and overall ignition timing of a lift charge and burst charge of the pyrotechnic device.

17 Claims, 12 Drawing Sheets

150
146
152
158
106
B
148
144
126
132
120
130
160
142
136
C
108
124
140
134
122
100
110

REMOTELY CONTROLLED IGNITION SYSTEM FOR PYROTECHNICS

CROSS REFERENCE TO RELATED APPLICATIONS

This application is a continuation of U.S. patent application Ser. No. 11/500,762, filed Aug. 7, 2006, now U.S. Pat. No. 7,757,607, which claims priority from U.S. Provisional Application Ser. No. 60/708,935 filed Aug. 17, 2005; the disclosures of which are incorporated herein by reference.

BACKGROUND OF THE INVENTION

1. Technical Field

The invention relates generally to a remotely controlled ignition system for pyrotechnic devices. More particularly, the invention relates to such a control system which is capable of wirelessly igniting pyrotechnic devices. Specifically, the invention relates to such a system where ignition is accomplished via electromagnetic induction.

2. Background Information

Ignition systems for fireworks or pyrotechnic devices are within three primary categories, namely manual firing, electrical firing and digital firing. Manual firing is the age-old process of igniting a fuse with a torch or some sort of hand lighter whereby a flame is the catalyst for igniting the fuse. In more recent decades, electrical firing has been utilized wherein an electrical ignitor known as an E-match or squib is inserted into the fuse or black powder of the pyrotechnic device so that an electrical current initiates the ignition of the fuse or black powder. Digital firing also involves the use of E-matches which are connected in the same manner to the pyrotechnic device and are also wired to a computer system in order to automatically shoot the fireworks. The digital systems are very expensive and are typically used with pyromusical productions.

The typical firework or pyrotechnic show or production typically involves the shooting of from 100 to 40,000 pyrotechnic devices. While manual firing is still the least expensive method of igniting pyrotechnic devices, the manual firing method presents obvious safety issues from the inability to ignite the fireworks remotely. While the electrical and digital firing methods provide for remote ignition of the pyrotechnic devices, nonetheless each firework requires one E-match. The labor for wiring each of these E-matches to the firing system is very time-consuming and cumbersome, and results in many wires disposed above the firing mortars of the pyrotechnic devices. It has been estimated that approximately half of the labor of setting up a pyrotechnic show is due to the wiring of these devices.

In addition, aside from the digital firing systems, there is a need within the pyrotechnic industry for a control mechanism to control the ignition of the lift charge and the burst charge of a pyrotechnic device, in particular the firing sequence thereof. The present invention addresses these and other problems within the art.

BRIEF SUMMARY OF THE INVENTION

The present invention provides an apparatus comprising a pyrotechnic mortar tube adapted to receive therein a pyrotechnic device which is launchable therefrom and which is adapted to be in electrical communication with a receiving induction member; and a transmitting induction coil which is adjacent the mortar tube and which is adapted to produce an electromagnetic field for inducing an electric current in the receiving induction member when the pyrotechnic device is within the mortar tube.

The present invention also provides an apparatus comprising a pyrotechnic device; and a receiving induction coil in electrical communication with the pyrotechnic device.

The present invention further provides a method comprising the steps of causing an electric current to flow in a transmitting induction coil to produce an electromagnetic field which induces an electrical current in a receiving induction member; and igniting a pyrotechnic device with the induced electric current.

BRIEF DESCRIPTION OF THE SEVERAL VIEWS OF THE DRAWINGS

Preferred embodiments of the invention, illustrative of the best modes in which applicant contemplates applying the principles, are set forth in the following description and are shown in the drawings and are particularly and distinctly pointed out and set forth in the appended claims.

Similar numbers refer to similar parts throughout the specification.

DETAILED DESCRIPTION OF THE INVENTION

Figure 1:
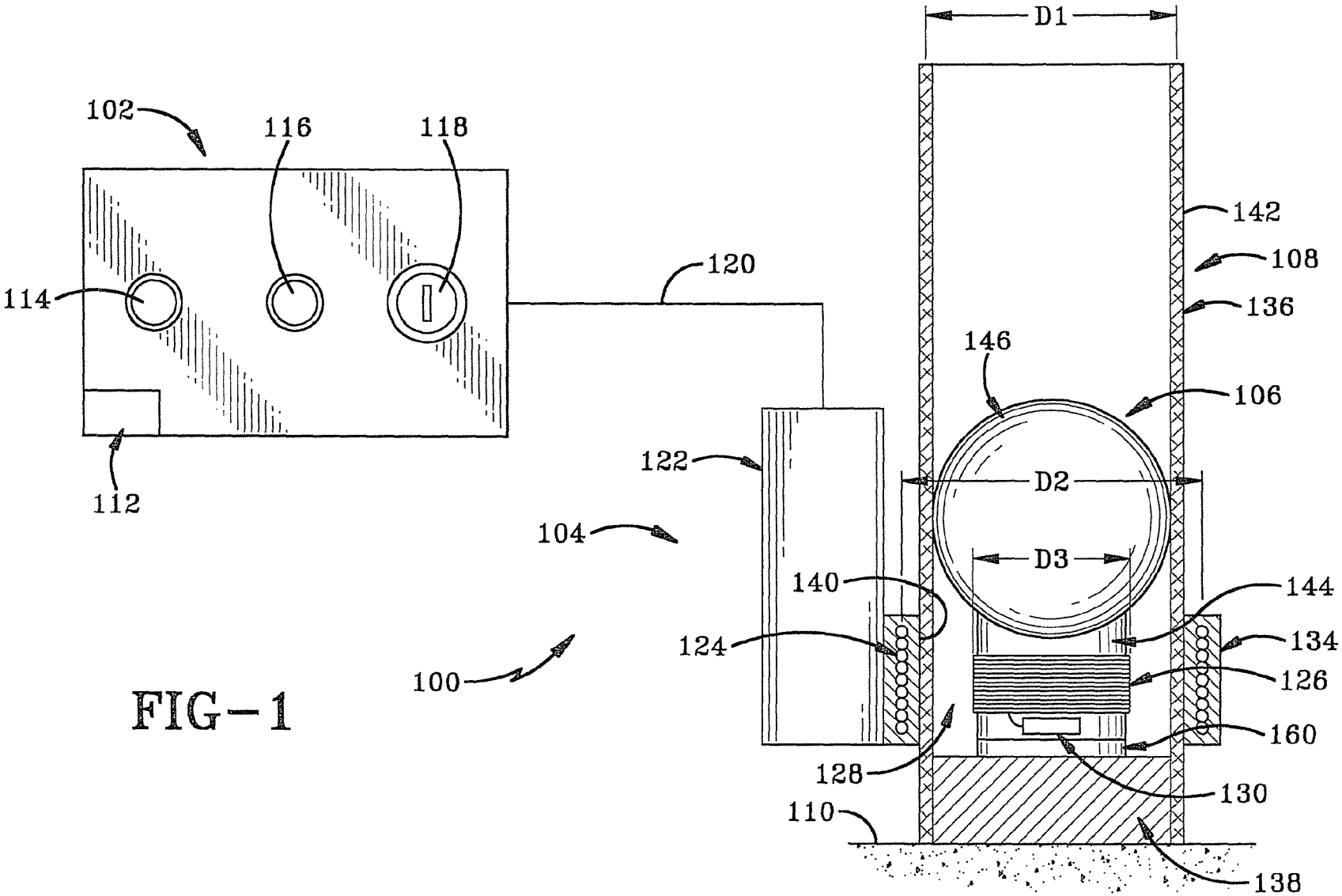
FIG. 1 is a diagrammatic view of the ignition system of the present invention including a sectional view of the mortar and the transmitting induction coil with a first embodiment of the pyrotechnic device of the present invention disposed within the mortar.
Figure 6:
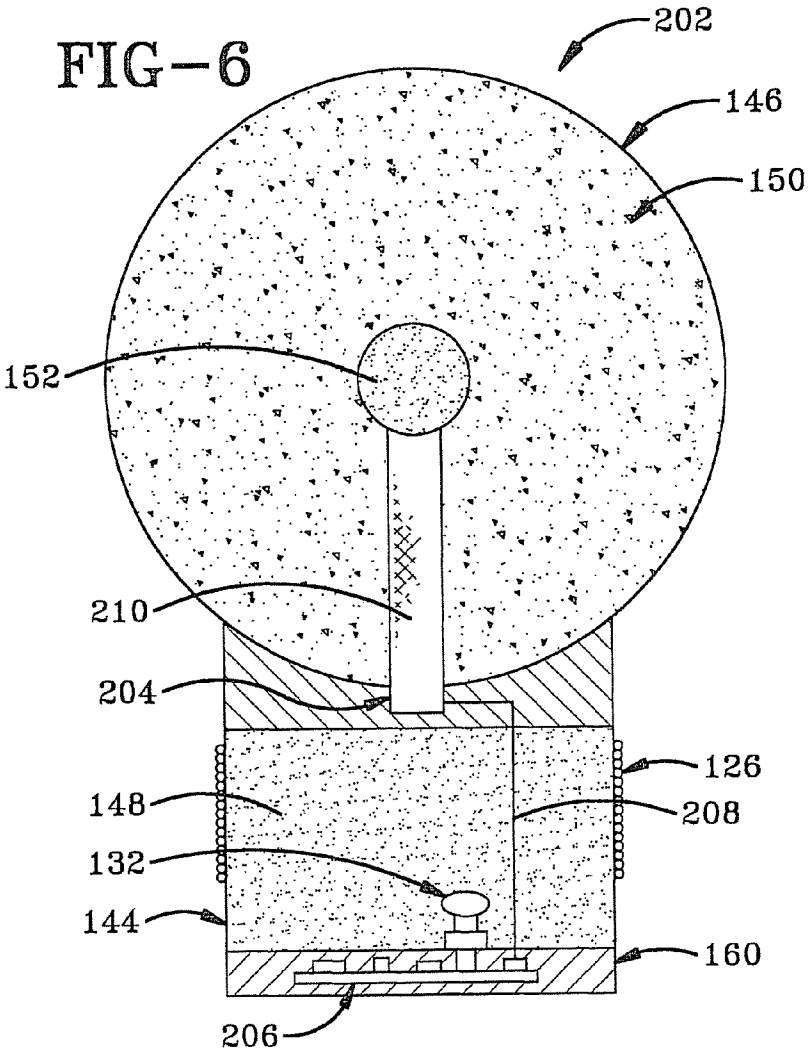
FIG. 6 is similar to FIG. 2 and shows a second embodiment of the pyrotechnic device of the present invention.
Figure 2:
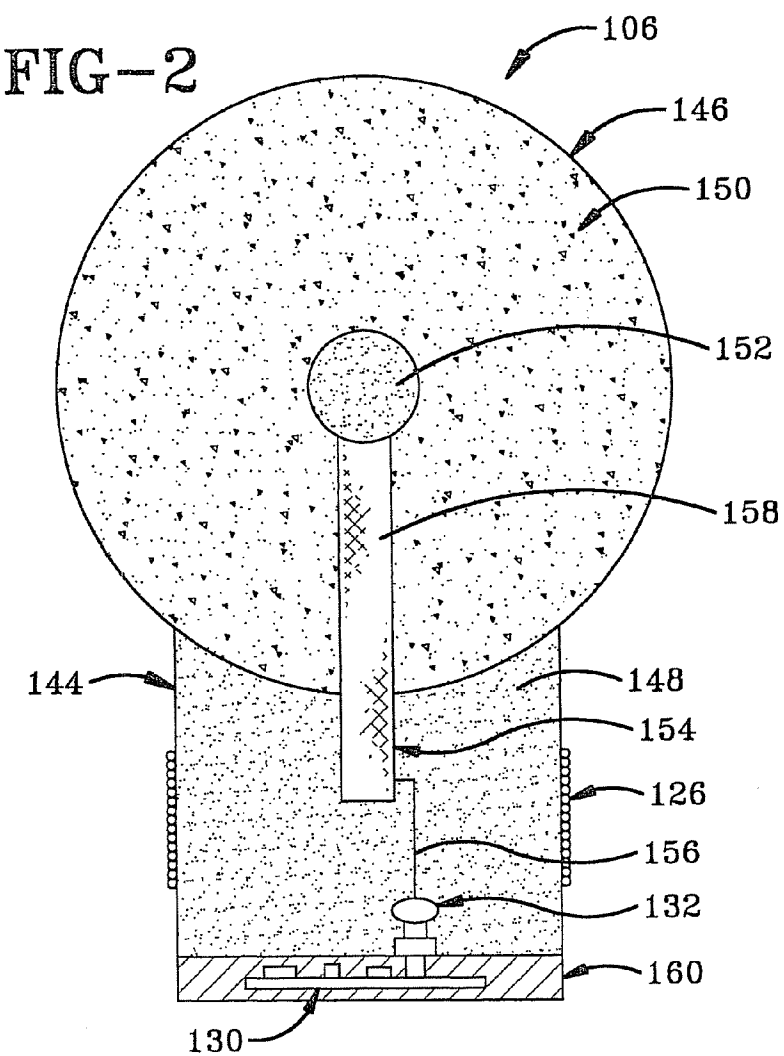
FIG. 2 is an enlarged sectional view of the first embodiment of the pyrotechnic device as viewed from the side.
Figure 7:
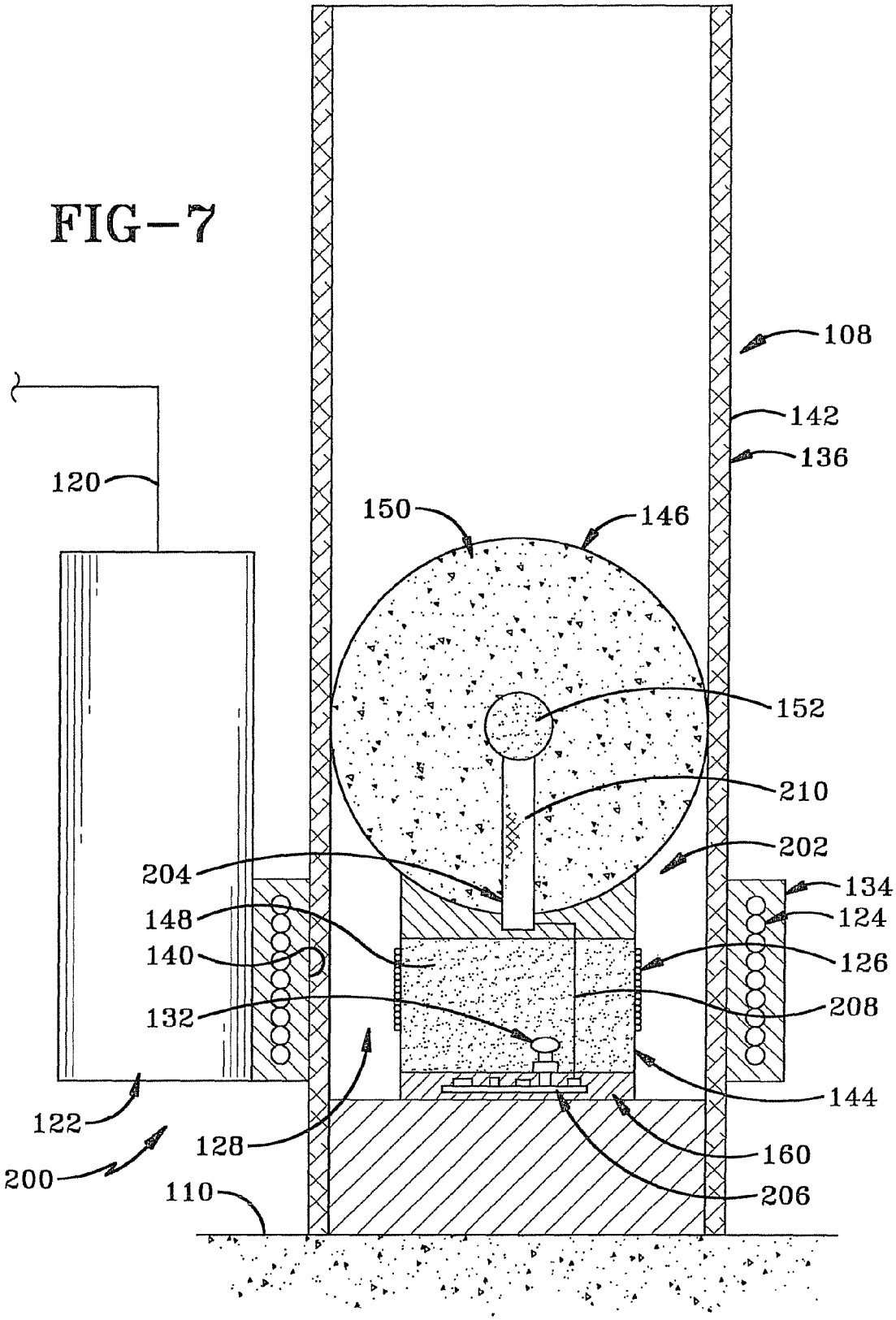
FIG. 7 is similar to FIG. 3 and shows the second embodiment.
Figure 10:
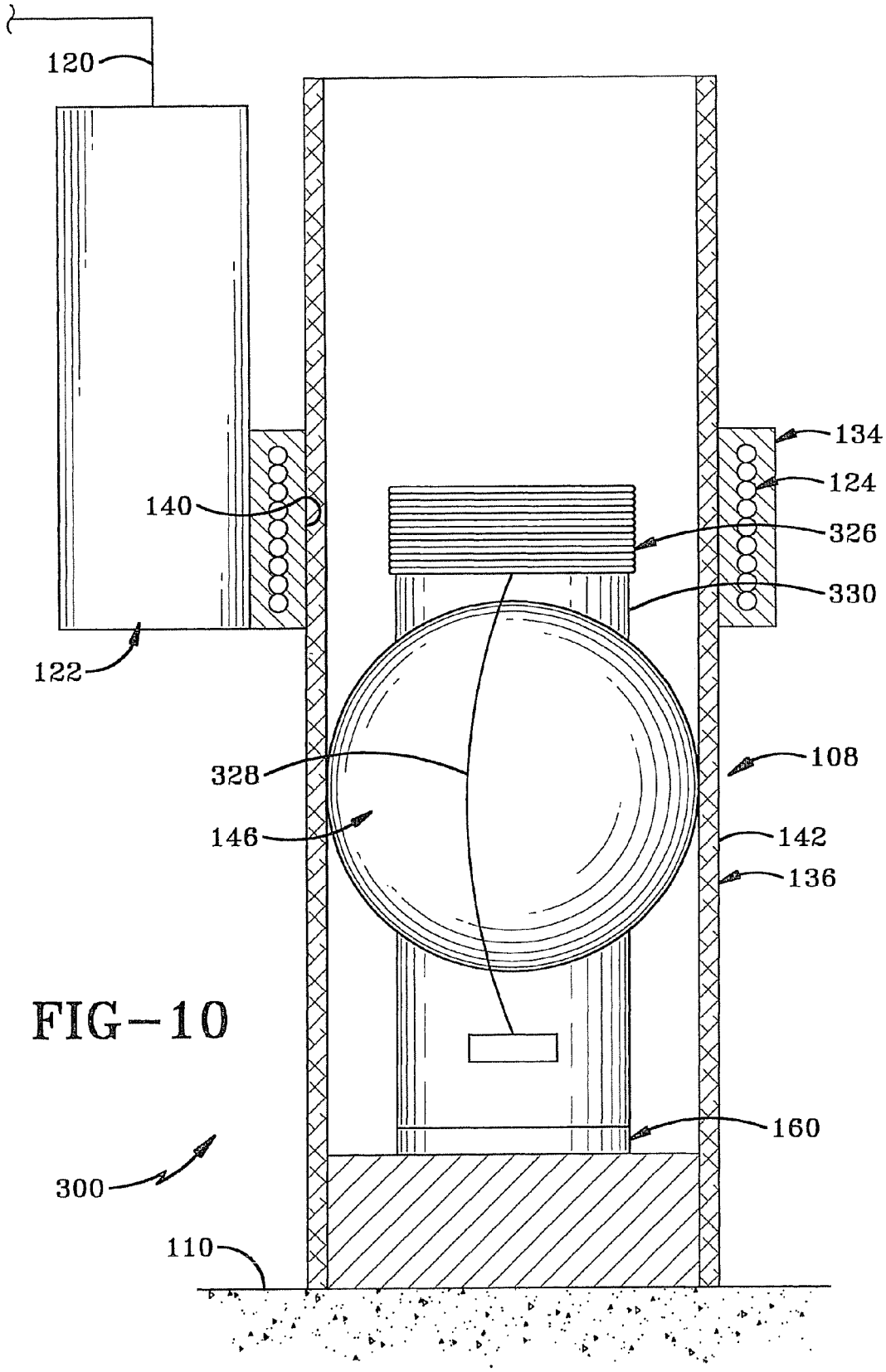
FIG. 10 is an enlarged fragmentary view similar to a portion of FIG. 1 and shows a third embodiment of the pyrotechnic device of the present invention.
Figure 11:
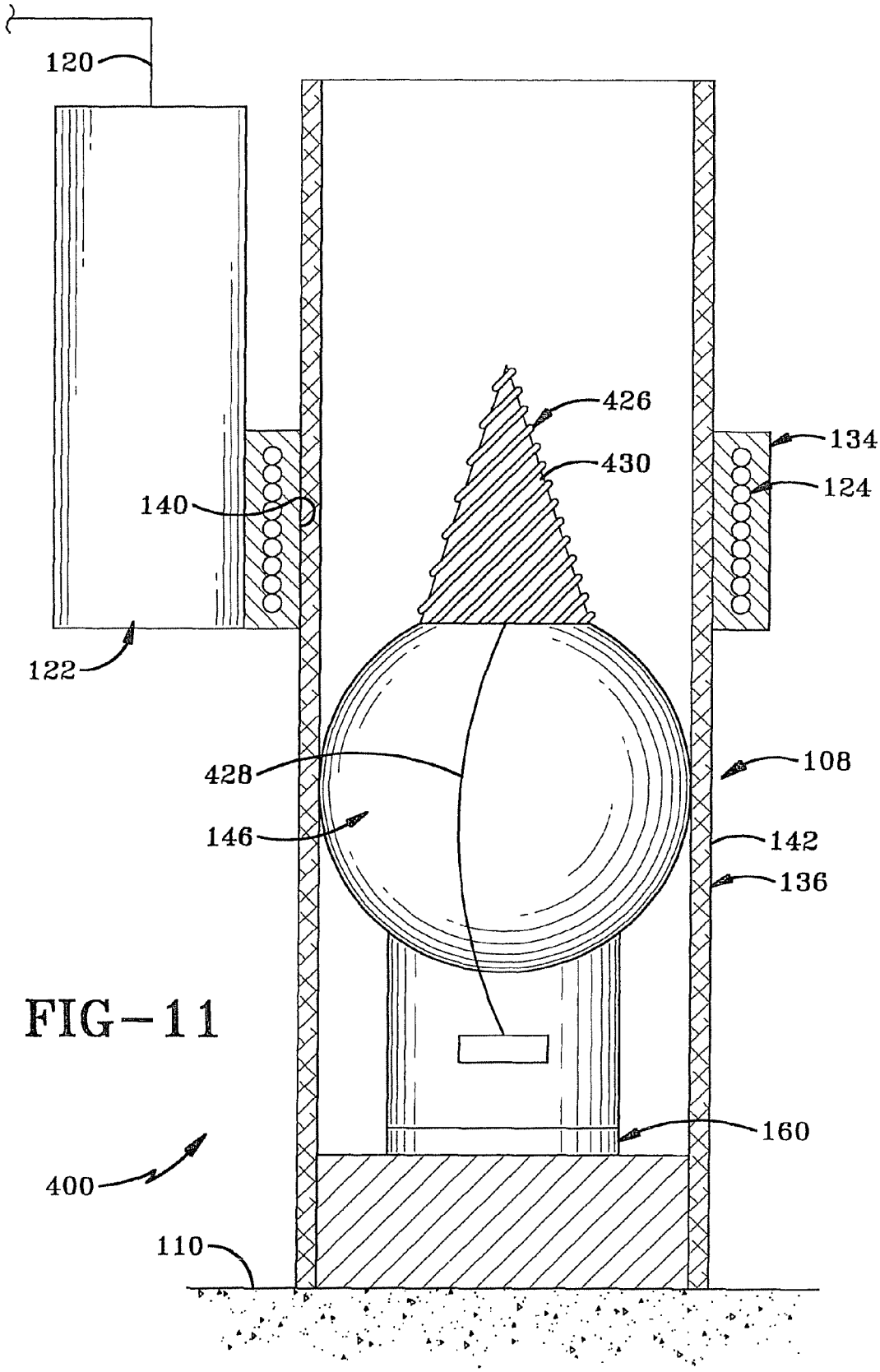
FIG. 11 is similar to FIG. 10 and shows a fourth embodiment of the pyrotechnic device of the present invention.
Figure 12:
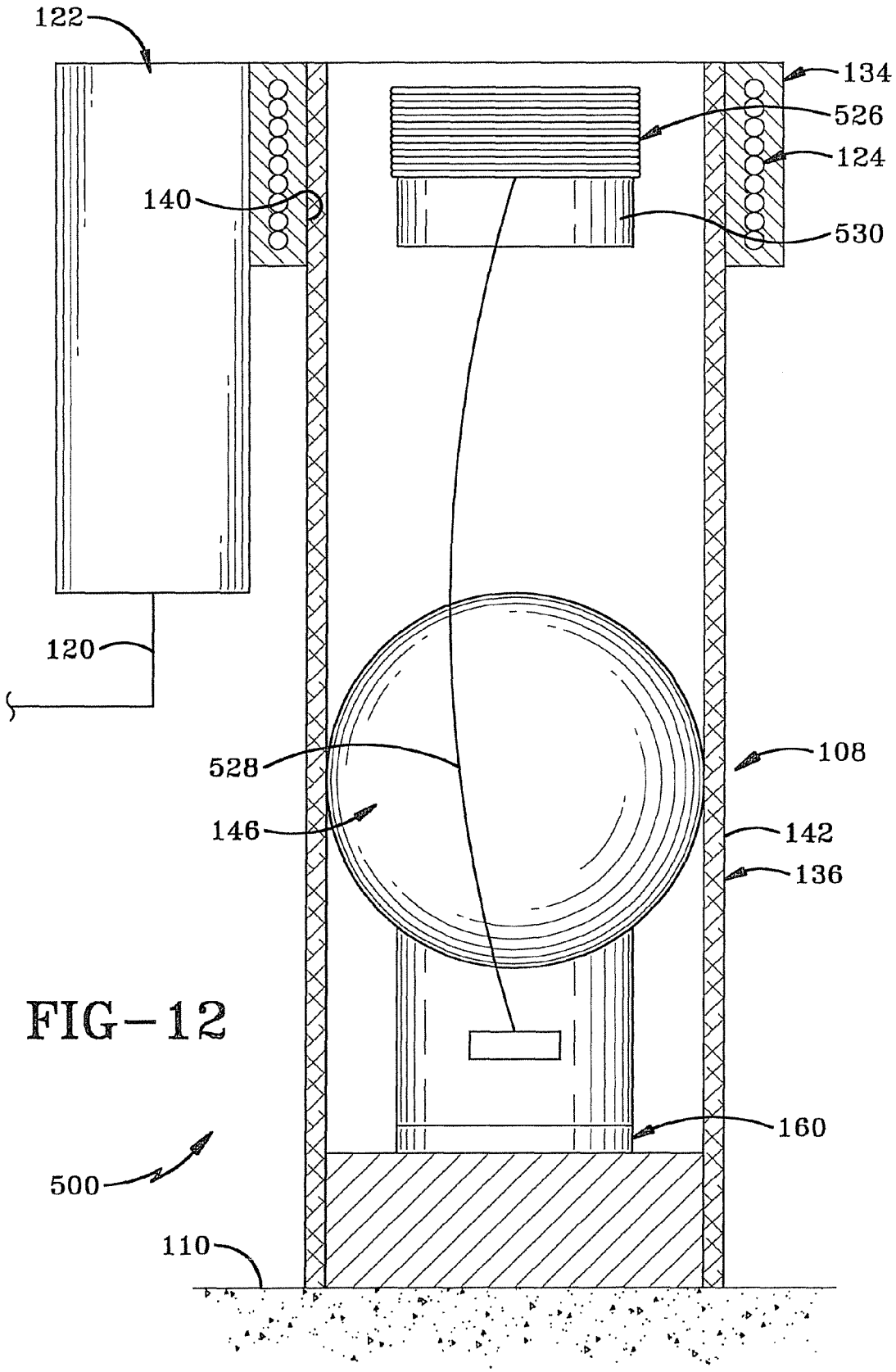
FIG. 12 is similar to FIG. 11 and shows a fifth embodiment of the pyrotechnic device of the present invention.
Figure 13:
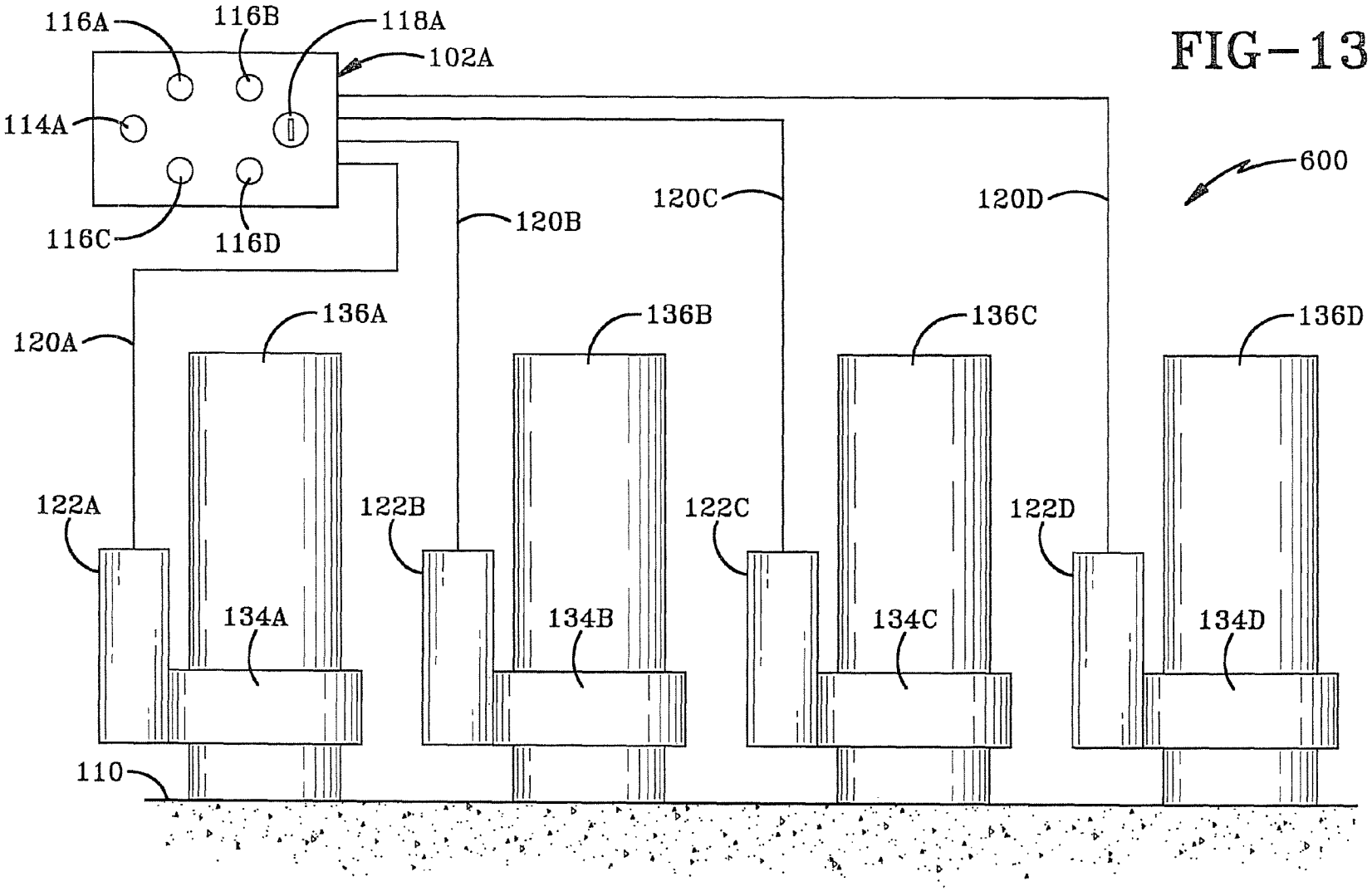
FIG. 13 is a diagrammatic view showing a sixth embodiment of the ignition system of the present invention set up for shooting a plurality of pyrotechnic devices.

A first embodiment of the ignition system of the present invention is indicated generally at 100 in FIGS. 1-2; a second embodiment is indicated generally at 200 in FIGS. 6-7; a third embodiment is indicated generally at 300 in FIG. 10; a fourth embodiment is indicated generally at 400 in FIG. 11; a fifth embodiment is indicated generally at 500 in FIG. 12; and a sixth embodiment is indicated generally at 600 in FIG. 13. Each of said ignition systems is configured to remotely ignite pyrotechnic devices.

With reference to FIG. 1, ignition system 100 includes an ignition control 102 and an ignition communication pathway 104 in communication with control 102 for igniting or shooting a pyrotechnic device 106 from a firework mortar 108 disposed on a launch surface 110, which may be the ground or any other suitable structure known in the art. Control 102 includes a power supply 112, a charge button 114, a fire button 116 and an on/off key switch 118. Communication pathway 104 includes a control cable 120 having a charging circuit and a triggering circuit, a capacitor 122, a transmitting induction coil or induction member 124, a susceptor in the form of a receiving induction member or coil 126, an electromagnetic field region or wireless portion 128, an electronic control device in the form of a circuit board 130 and an E-match ignition device 132 (FIG. 2). Transmitting induction coil 124 is encased in a waterproof annular housing 134 which is typically over molded onto coil 124 and includes electronic shielding. Mortar 108 includes a mortar tube 136 which is typically cylindrical and a mortar plug 138 disposed within tube 136 adjacent a bottom end thereof. Pyrotechnic device 106 is seated atop mortar plug 138 within mortar tube 136 and is further described below.

Power supply 112 of control 102 is typically in the form of a battery or batteries although other power sources may be used. Charge button 114 is an electric switch for selectively opening and closing the charging circuit of control cable 120 for selectively charging capacitor 122. Fire button 116 is also an electrical switch for selectively opening and closing the triggering circuit of control cable 120 to selectively discharge capacitor 122. Thus, the charging circuit and triggering circuit of control cable 120 are in electrical communication with capacitor 122, which is in electrical communication with induction coil 124. Coils 124 and 126 are spaced from one another by wireless portion 128 of communication pathway 104 and by a portion of mortar tube 136. Each of coils 124 and 126 are substantially cylindrical although this may vary. Receiving coil 126 is in electrical communication with circuit board 130 which is in electrical communication with ignition device 132 (FIG. 2). Coils 124 and 126 are part of an electromagnetic induction assembly whereby an electric current flowing through coil 124 produces an electromagnetic field to induce an electric current in receiving coil 126.

Preferably, housing 134 has an inner surface 140 which is of a mating configuration with an outer surface 142 of mortar tube 136. It is preferred that housing 134 is slidable over mortar tube 136 while inner surface 140 is in frictional engagement with outer surface 142 to a degree which allows this slidable characteristic while also allowing housing 134 to be positioned on tube 136 and held in place simply by the frictional engagement therebetween. However, housing 134 may be held in position on tube 136 by any securing mechanism known in the art. Mortar tube 136 has a sectional width or diameter D1, transmitting coil 124 has a sectional width or diameter D2 which is greater than diameter D1 and receiving coil 126 has a sectional width or diameter D3 which is less than diameter D1. Diameter D1 of mortar tube 136 typically ranges from approximately 2 inches to 24 inches. The diameters of mortar tubes 136 which are commonly in use include 2", 2.5", 3", 4", 5", 6", 8", 10", 12", 16" and 24". Depending on the diameter D1 of tube 136, diameters D2 and D3 will vary accordingly.

Transmitting coil 124 is configured to be tuned to a specific frequency or narrow frequency range and receiving coil 126 is likewise configured so that the frequency or narrow range of each of coils 124 and 126 are matched in order to only allow the proper pyrotechnic device to be fired. Thus, for instance, if a pyrotechnic device of the wrong size is placed in mortar tube 136 and thus has a receiving coil 126 which is not matched in frequency to transmitting coil 124, an electrical current will not be induced in receiving coil 126 when an electrical current is passed through transmitting coil 124 and the improper pyrotechnic device will not be ignited, or an insufficient current will be produced in coil 126 for igniting such a device. Mortar tube 136 is formed of a non-metallic material in order to allow the electromagnetic field produced by the electric current within transmitting coil 124 to pass through tube 136 and induce an electrical current within receiving coil 126. Typically, mortar tube 136 is formed of a fiber composite material although this may vary.

With reference to FIG. 2, pyrotechnic device 106 is further described. Device 106 includes a lift charge chamber 144 and a star chamber 146 disposed above and mounted on lift charge chamber 144. Lift chamber 144 contains a lift charge 148 which is typically in the form of black powder and star chamber 146 contains pyrotechnic color stars 150 for producing the color displays commonly associated with a fireworks show. Device 106 further includes a burst charge 152 disposed within star chamber 146 and a timing fuse 154. Timing fuse 154 may be an E-match for electrically igniting burst charge 152, or may be a burning-type fuse or a combination thereof. FIG. 2 shows timing fuse 154 as a first fuse 156 and a second fuse 158 in the form of a black match. First fuse 156 communicates with ignition device 132 and second fuse 158, which communicates with burst charge 152. Thus, second fuse 158 is partially disposed within star chamber 150 and partially disposed within lift chamber 144 while first fuse 156 is disposed entirely within lift chamber 144 along with ignition device 132. Lift chamber 144 further includes a bottom wall 160 which encases circuit board 130.

Figure 3:
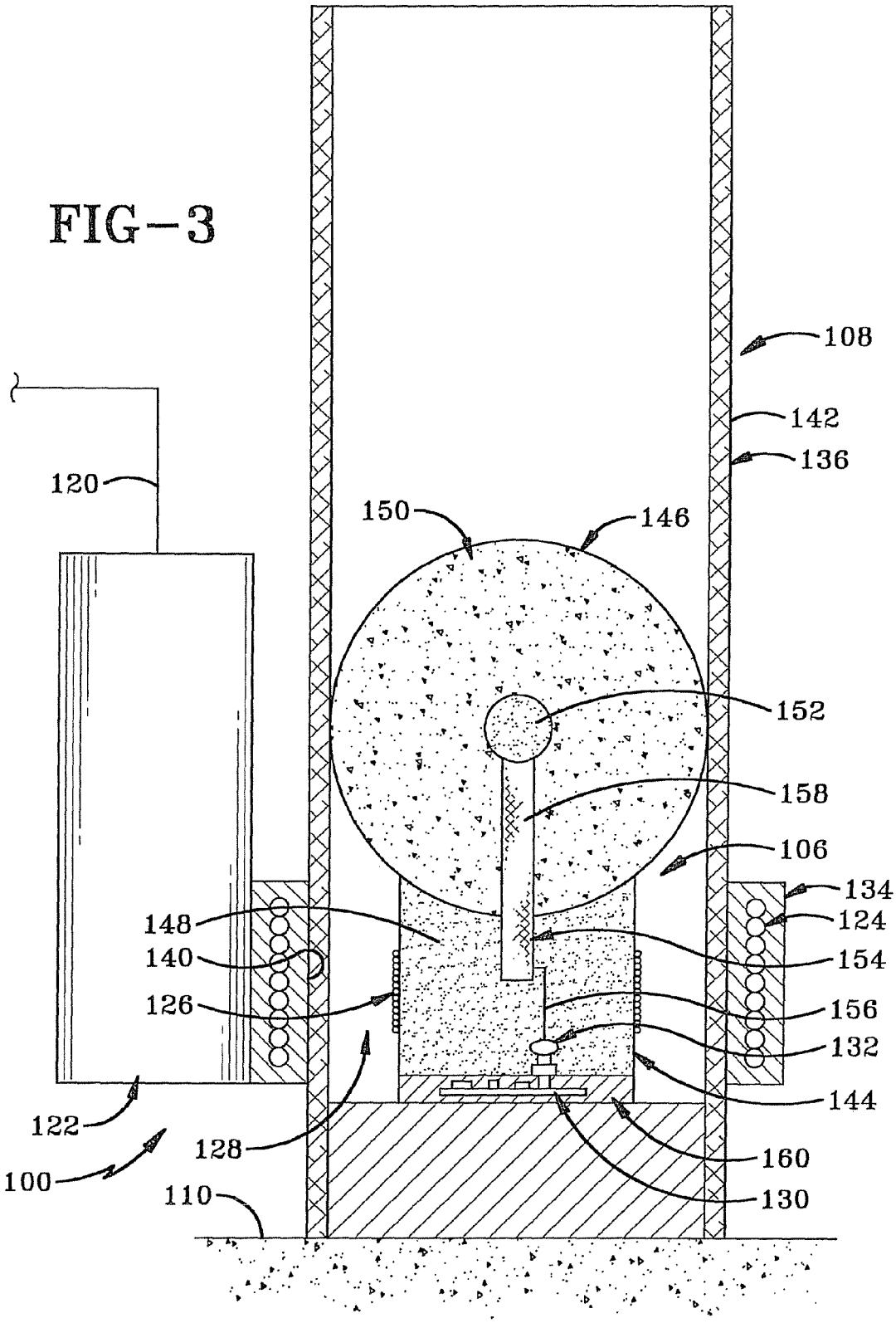
FIG. 3 is an enlarged fragmentary view of a portion of FIG. 1 showing the mortar and first embodiment of the pyrotechnic device in section prior to ignition of the device.

The operation of system 100 is now described with reference to FIGS. 1 and 3-5. Once system 100 is properly set up, an operator is ready to remotely ignite or shoot pyrotechnic device 106. With reference to FIG. 1, the operator will first turn key switch 118 to an "on" position in order to provide power to system 100 via power source 112. Charge button 114 is then depressed to close the charging circuit in order to charge capacitor 122. In order to ignite and shoot pyrotechnic device 106, fire button 116 is then depressed to close the firing circuit, which discharges capacitor 122 to produce an electrical current within transmitting coil 124. Due to the nature of the discharge of capacitor 122, the electrical current only flows for a relatively brief time in a short pulse of energy. The electric current flowing in coil 124 produces an electromagnetic field within mortar tube 136 across region 128 in order to produce an electrical current within receiving coil 126 which flows to circuit board 130 and E-match device 132 (FIG. 3). While the strength of the electrical current within receiving coil 126 may vary, it will likely be on the order of 500 milliamps at 1 volt, typically the power required to ignite an electric ignition device such as device 132.

Figure 4:
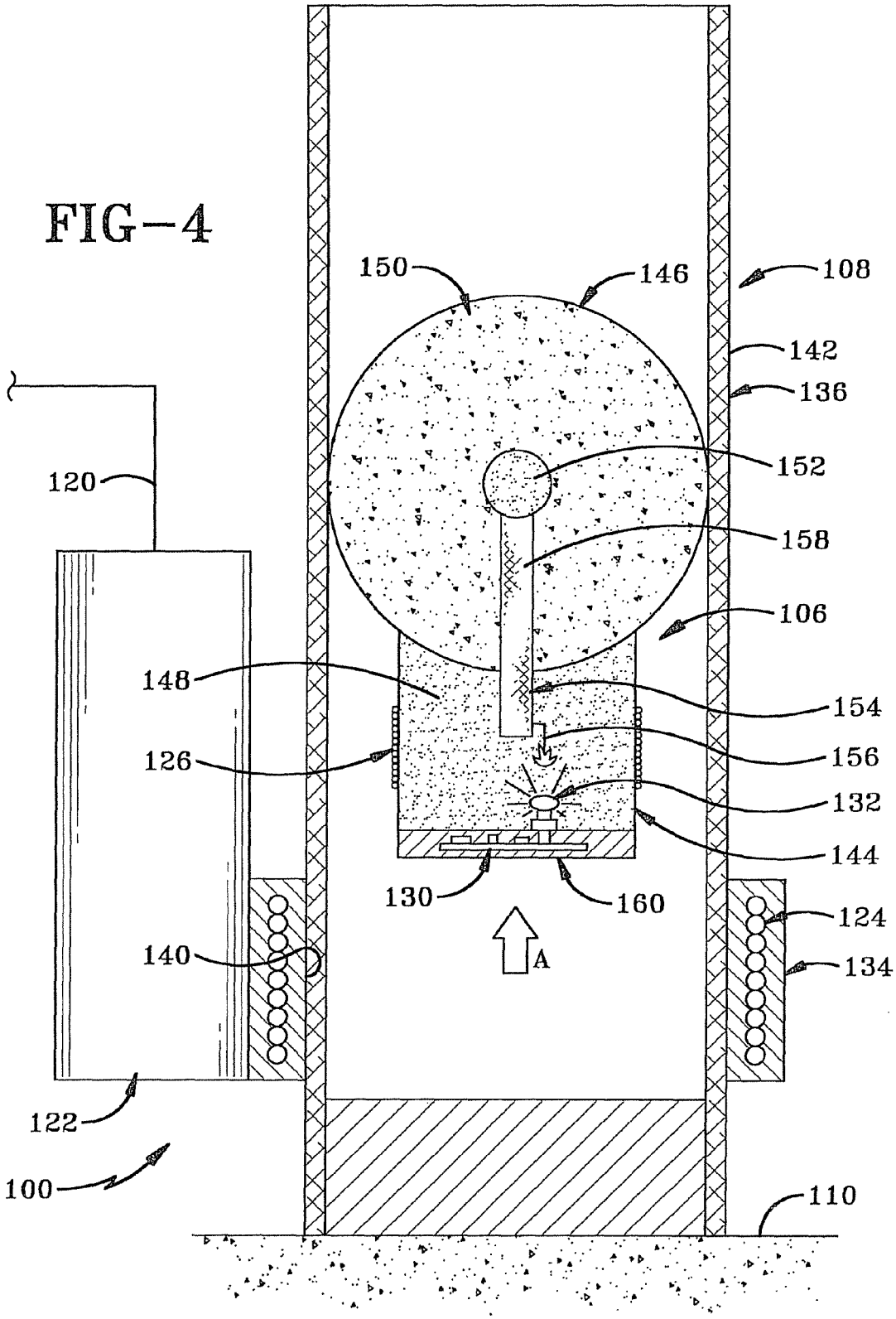
FIG. 4 is similar to FIG. 3 and shows the lift charge and timing fuse having been ignited and the pyrotechnic device at an early stage of launching.
Figure 5:
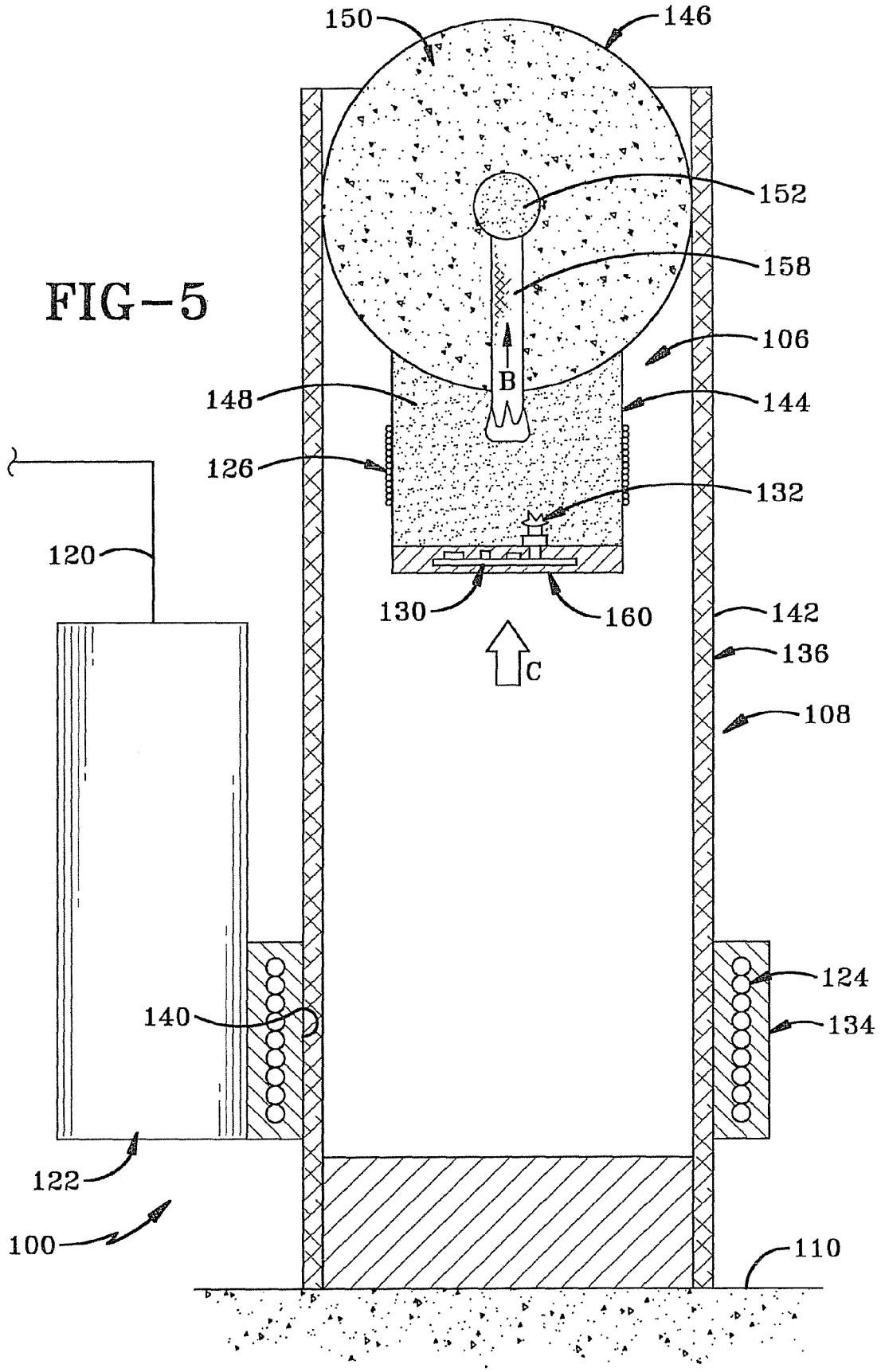
FIG. 5 is similar to FIG. 4 and shows the timing fuse at a subsequent stage of burning and the pyrotechnic device at a subsequent stage of launching.

FIG. 3 shows pyrotechnic device 106 prior to the electrical current reaching ignition device 132. In FIG. 4, the electric current has reached and ignited ignition device 132 which in turn has ignited first fuse 156 of timing fuse 154 as well as lift charge 148 whereby device 106 is at an initial stage of lifting or launching upwardly as indicated by Arrow A in FIG. 4. FIG. 4 shows first fuse 156 burning toward second fuse 158 and FIG. 5 shows second fuse 158 having been ignited and burning in the direction shown at Arrow B toward burst charge 152 as pyrotechnic device 106 continues upwardly as indicated at Arrow C in FIG. 5. Thus, pyrotechnic device 106 will have shot upwardly to a desired height when timing fuse 154 ignites burst charge 152 in order to produce the firework display.

With reference to FIG. 6, a firework or pyrotechnic device 202 associated with system 200 of the present invention is described. Device 202 is similar to device 106 except that it has a timing fuse 204 which is connected directly to an alternate circuit board 206 instead of to ignition device 132. More particularly, timing fuse 204 includes a first fuse 208 and a second fuse 210 connected to one another with first fuse 208 connected to circuit board 206 and second fuse 210 communicating with burst charge 152.

Figure 8:
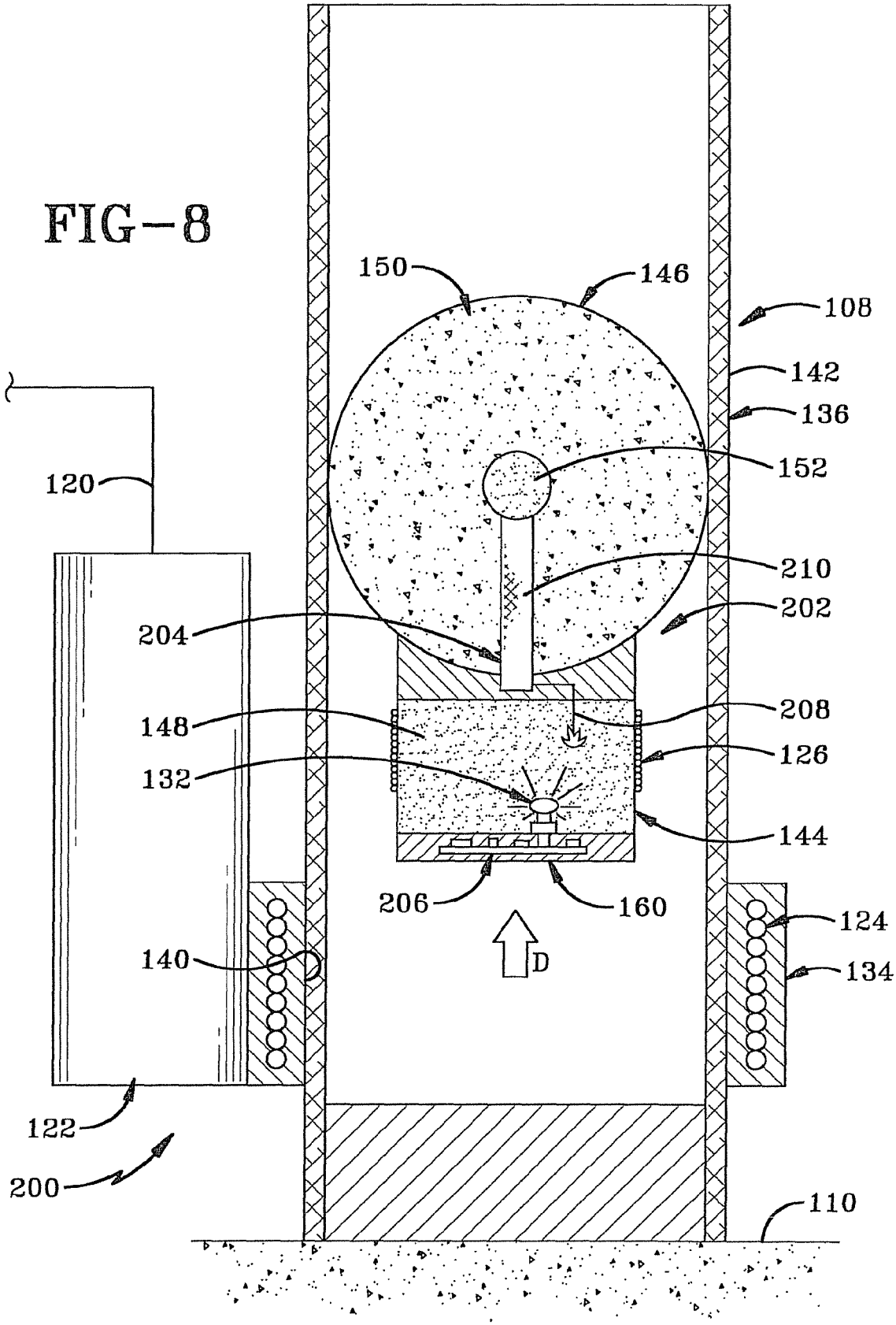
FIG. 8 is similar to FIG. 7 and shows that the first charge and timing fuse have been ignited with the pyrotechnic device at an early stage of launching.
Figure 9:
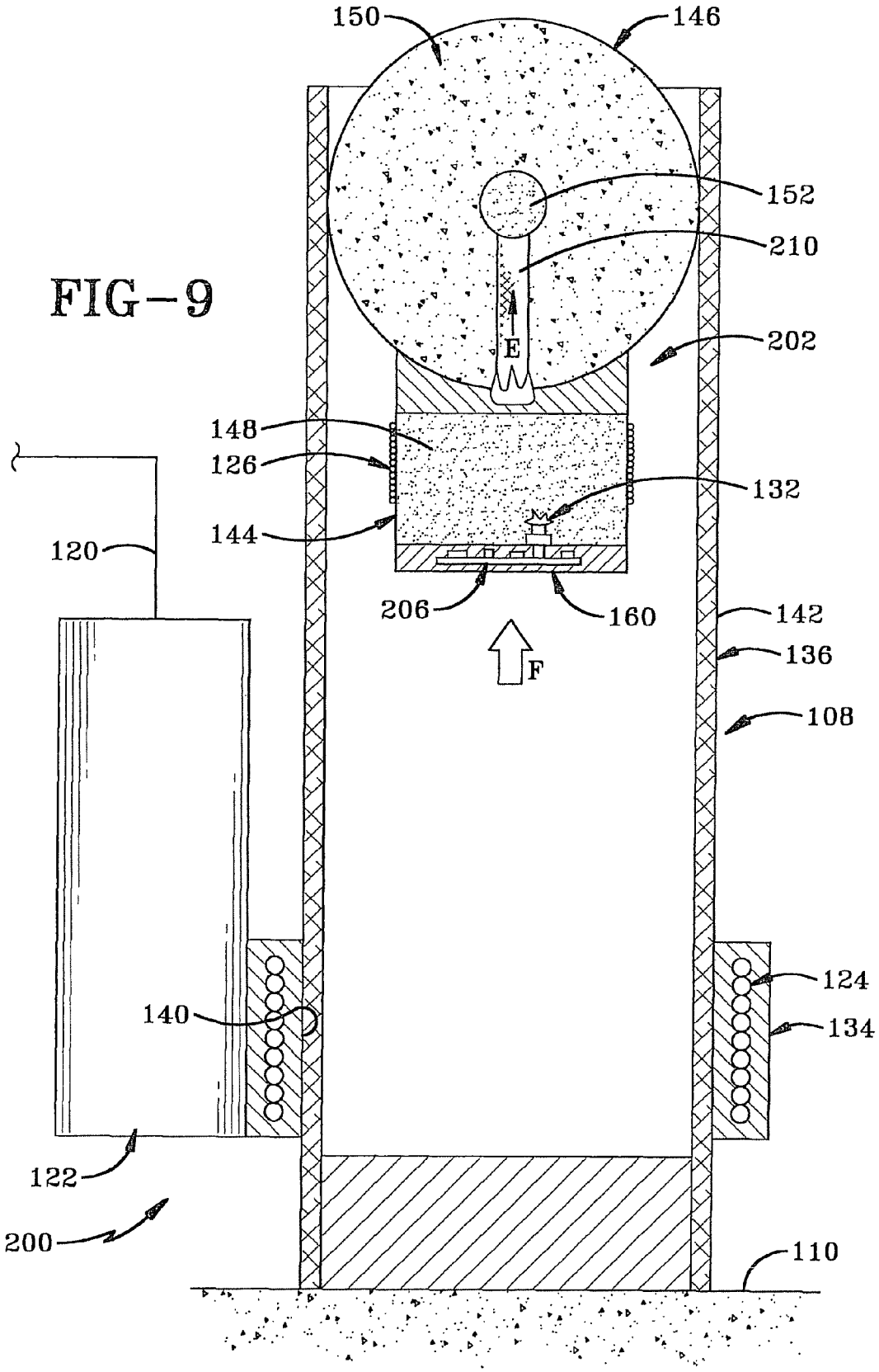
FIG. 9 is similar to FIG. 8 and shows the timing fuse at a further stage of burning and the second embodiment pyrotechnic device at a further stage of launching.

With reference to FIGS. 7-9, system 200 operates in a similar fashion as that of system 100 except for the control of the ignition via circuit board 206. FIG. 7 shows pyrotechnic device 202 prior to the electric current flowing into circuit board 206 and ignition device 132. Once the firing sequence has been initiated by pushing fire button 116 (FIG. 1), the electrical current produced as described with regard to system 100 flows into circuit board 206 and ignites ignition device 132 in order to ignite lift charge 148 to begin lifting device 202 upwardly as indicated by Arrow D in FIG. 8. In contrast to system 100, circuit board 206 directly controls the ignition of first fuse 208 without the use of ignition device 132. Thus, circuit board 206 is configured with an electronic timing device which ignites first fuse 208 at a predetermined time with regard to the ignition of device 132, thus controlling the sequencing of igniting device 132 and timing fuse 204. FIG. 8 shows first fuse 208 burning and FIG. 9 shows second fuse 210 having been ignited and burning toward burst charge 152 as indicated at Arrow E as pyrotechnic device 202 is at a later stage of lifting as indicated by Arrow F. Thus, system 200 uses a different timing device than that of system 100. The advantages of system 200 allows for the separate control of the sequence of igniting the burst charge and igniting the timing fuse and is particularly suited to the use of an E-match fuse (also represented by 204) because the timing of ignition of the E-match fuse may be controlled entirely by circuit board 206. Thus, for instance, circuit board 206 may be configured to allow ignition device 132 to be ignited immediately upon the flow of current through circuit board 206 and then delay the flow of current to the timing fuse for a period of time so that, for example, pyrotechnic device 202 is substantially at the height desirable for igniting burst charge 152 when an E-match fuse 204 is ignited by circuit board 206.

With reference to FIG. 10, system 300 is similar to systems 100 and 200 with the primary distinction being the position of capacitor 122, transmitting coil 124 and a receiving coil 326 which is similar to coil 126. The only substantial difference between coil 326 and 126 is that coil 326 has a longer lead wire 328 and that coil 326 is mounted on a cylindrical upward projection mounted atop star chamber 146. Otherwise, the operation of system 300 is the same as either system 100 or system 200.

With reference to FIG. 11, system 400 is similar to system 300 in that capacitor 122, transmitting coil 124 and a receiving coil 426 are disposed above star chamber 146 and mounted thereon. In addition, receiving coil 426 is configured in a substantially conical shape and is mounted on a cone-shaped device 430 which is mounted on star chamber 146. The windings of coil 426 are shown at an angle instead of being perpendicular to the direction of firing of the pyrotechnic device. System 400 thus shows but one example of an alternately-shaped receiving coil to indicate that a receiving coil may be in any suitable shape which allows for the flow of electrical current via the inductive process as previously described. Otherwise, system 400 functions in the same manner as described with regard to either system 100 or 200.

With reference to FIG. 12, system 500 shows a receiving coil 526 which is cylindrical like those shown in systems 100, 200 and 300. However, receiving coil 526 is elevated toward the top of mortar tube 136 and is not mounted on the pyrotechnic device but is only in electrical communication therewith via a lead wire 528. Coil 526 is mounted on a cylindrical support 530 which is disposed adjacent an upper end of mortar tube 136. Capacitor 122 and transmitting coil 124 are shown in an inverted position with respect to the other embodiments although there is no structural change.

FIG. 13 shows system 600 which includes a plurality of pyrotechnic launching devices each of which may be configured as described with regard to previous embodiments. More particularly, system 600 includes a control 102A which is similar to control 102 of system 100 except for it is configured for shooting multiple pyrotechnic devices. Unit 102A includes a charge button 114A, four fire buttons 116A-D and a key switch 118A which are analogous and function in the same manner as described with regard to buttons 114 and 116 and switch 118 of system 100. Control cables 120A-D are in electrical communication respectively with fire buttons 115A-D and each of control cables 120A-D also is in communication with charge button 114A. Control cables 120A-D are also respectively in electrical communication with capacitors 122A-D which in turn are in electrical communication with transmitting coils (not shown) respectively within housings 134A-D which are mounted respectively on mortar tubes 136A-D. System 600 shows the concept of the invention as it would be used with a plurality of pyrotechnic devices.

In operation, system 600 would operate as described with regard to systems 100 and 200 except that button 114A would be pushed to close the charging circuit in order to charge all of capacitors 122A-D associated with the pyrotechnic devices located within mortar tubes 136A-D, and then fire buttons 116A-D may be pushed individually to respectively control the ignition of the pyrotechnic devices located respectively within tubes 136A-D. Each of fire buttons 116A-D may control the ignition of a single pyrotechnic device or a plurality thereof, for instance a row of such devices. As previously noted with regard to system 100, each housing 134A-D includes a shielding device which is important with regard to having the pyrotechnic devices located in relatively close proximity to one another. The electronic shielding device prevents inadvertent firing of a pyrotechnic device which is adjacent another pyrotechnic device being fired. More particularly, the shielding device prevents the electromagnetic field produced by the transmitting coil from extending to another transmitting or receiving coil associated with another pyrotechnic device in nearby proximity.

Thus, systems 100-600 of the present invention provide remote ignition systems which allow for the reuse of mortar tubes and the reuse of the capacitors and transmitting coils. For instance, an operator of the systems may fire a first pyrotechnic device or a set thereof from one or more mortar tubes 136 and then reload these mortar tubes with additional pyrotechnic devices during a show in order to minimize the number of mortar tubes and associated elements of the system needed in order to fire a given number of pyrotechnic devices. In addition, the present invention substantially reduces the amount of time for setting up a fireworks show due to the elimination of the vast amount of wiring required with prior art devices. The present invention also provides a two-stage firing sequence in addition to the on/off switch for the control and power supply. This two-stage firing sequence, involving activation of the charge button to charge the capacitor and subsequent activation of the fire button to discharge the capacitor, provides a safety mechanism to help ensure that none of the fireworks will be shot while the operator is reloading the mortar tubes with additional fireworks. The wireless ignition of the pyrotechnic device allows for a safe separation of the device from the mortar.

Preferably, the transmitting coils and associated receiving coils used with pyrotechnic devices which are shot from a mortar tube of a particular diameter will be tuned to a certain frequency or frequency range which is different from analogous coils for pyrotechnics associated with mortar tubes having a different diameter. This would prevent the inadvertent firing of pyrotechnic devices which are not sized to fit with a particular mortar tube.

The induction system of the present invention has primarily been described with reference to a transmitting induction coil and a receiving induction coil. However, any suitable electrically conductive members may be used as the transmitting and the receiving members of the induction system as long as they are suitably configured for the purpose. In addition, while it is preferred that the transmitting member be an induction coil within a housing as described which may be slid onto the mortar tube, the transmitting induction member may be, for example, simply disposed to one side of the mortar tube in order to produce an electromagnetic field sufficient to create the electrical current within the receiving induction member. In addition, it is noted that the induction system of the present invention may be used without the circuit board and vice versa although the wireless aspect of the induction system facilitates the launching of the pyrotechnic device with the circuit board without concern for separation of a physical connection between an E-match and the circuit board. Various other changes within the scope of the present invention will be evident to one skilled in the art.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. An apparatus comprising:
a pyrotechnic mortar tube;
a pyrotechnic device which is receivable in and launchable from the mortar tube;
a receiving induction member in electrical communication with the pyrotechnic device; and
a transmitting induction coil which is adjacent the mortar tube and which is adapted to produce an electromagnetic field for inducing an electric current in the receiving induction member when the pyrotechnic device is within the mortar tube.

2. The apparatus of claim 1 further comprising an outer surface of the mortar tube; and wherein the transmitting induction coil encircles the outer surface of the mortar tube.

3. The apparatus of claim 2 further comprising an annular housing which encircles the outer surface of the mortar tube; and wherein the transmitting induction coil is within the housing.

4. The apparatus of claim 1 further comprising
an outer surface of the mortar tube; and
a housing which houses the transmitting induction coil and slidably engages the outer surface.

5. The apparatus of claim 4 wherein the housing is selectively securable at a desired position on the mortar tube via frictional engagement between the housing and outer surface.

6. The apparatus of claim 1 further comprising
a capacitor which is in electrical communication with the transmitting induction coil.

7. The apparatus of claim 6 further comprising a housing which houses the transmitting induction coil; and wherein the capacitor is mounted on the housing.

8. The apparatus of claim 1 wherein the transmitting induction coil is external to the mortar tube and the receiving induction member is within the mortar tube.

9. The apparatus of claim 1 wherein the receiving induction member is mounted on and launchable with the pyrotechnic device from the mortar tube.

10. The apparatus of claim 1 wherein the receiving induction member is a receiving induction coil.

11. The apparatus of claim 1 wherein the transmitting induction coil encircles at least one of a portion of the pyrotechnic device and a portion of the induction member.

12. The apparatus of claim 1 further comprising an electric power source in electrical communication with the transmitting induction coil.

13. The apparatus of claim 1 further comprising an electronic shielding device disposed adjacent the transmitting induction coil and adapted to prevent the electromagnetic field produced by the transmitting induction coil from causing inadvertent firing of a nearby pyrotechnic device.

14. The apparatus of claim 13 further comprising a housing which houses the transmitting induction coil; wherein the housing comprises the electronic shielding.

15. An apparatus comprising:
a pyrotechnic mortar tube;
a pyrotechnic device launchable from the mortar tube; and
an electronic control device mounted on the pyrotechnic device for controlling ignition of the pyrotechnic device;
a transmitting induction coil adjacent the mortar tube; and
a receiving induction member in electrical communication with the pyrotechnic device;
wherein the pyrotechnic device is launchable from the mortar tube in response to an electric current induced in the receiving induction member by an electromagnetic field produced by the transmitting induction coil.

16. The apparatus of claim 15 wherein the electronic control device comprises a circuit board.

17. An apparatus comprising:
a pyrotechnic mortar tube;
a pyrotechnic device which is launchable from the mortar tube and which comprises a lift charge and a burst charge; and
an electronic control device mounted on the pyrotechnic device for controlling ignition sequencing of the lift charge and burst charge;
a transmitting induction coil adjacent the mortar tube; and
a receiving induction member in electrical communication with the pyrotechnic device;
wherein the pyrotechnic device is launchable from the mortar tube in response to an electric current induced in the receiving induction member by an electromagnetic field produced by the transmitting induction coil.

* * * * *